US007096536B2

(12) United States Patent
Johnson

(10) Patent No.: US 7,096,536 B2
(45) Date of Patent: Aug. 29, 2006

(54) HINGE APPARATUS WITH CHECK MECHANISM

(75) Inventor: Lawrence W. Johnson, Taylor, MI (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 10/419,645

(22) Filed: Apr. 21, 2003

(65) Prior Publication Data

US 2003/0226237 A1 Dec. 11, 2003

Related U.S. Application Data

(60) Provisional application No. 60/386,827, filed on Jun. 7, 2002.

(51) Int. Cl.
*E05F 1/08* (2006.01)

(52) U.S. Cl. ..... 16/300; 16/50; 16/334; 16/330; 16/317; 16/341

(58) Field of Classification Search ..... 16/300, 16/334, 330, 50, 303, 312, 317, 318, 341, 16/340, 315, 314
See application file for complete search history.

(56) References Cited

U.S. PATENT DOCUMENTS

| | | | | | |
|---|---|---|---|---|---|
| 294,746 | A * | 3/1884 | Straup et al. | 16/330 |
| 571,133 | A * | 11/1896 | Hoffman | 16/303 |
| 769,035 | A * | 8/1904 | Walter | 16/330 |
| 975,097 | A * | 11/1910 | Wright | 16/330 |
| 1,429,416 | A * | 9/1922 | Thomas | 16/330 |
| 1,440,713 | A * | 1/1923 | Ausborne | 16/324 |
| 1,465,912 | A * | 8/1923 | Jensen | 16/330 |
| 1,489,679 | A * | 4/1924 | Thornton | 16/329 |
| 1,946,837 | A * | 2/1934 | Clayton | 16/330 |
| 2,097,651 | A * | 11/1937 | Stangeland | 16/330 |
| 3,518,716 | A * | 7/1970 | Larson | 16/284 |
| 5,104,161 | A * | 4/1992 | Kautt | 292/157 |
| 5,125,131 | A * | 6/1992 | Leblanc | 16/330 |
| 5,408,726 | A * | 4/1995 | Kent | 16/326 |
| 5,906,029 | A * | 5/1999 | Fox | 16/386 |
| 5,970,819 | A * | 10/1999 | Katoh | 74/531 |
| 6,115,886 | A * | 9/2000 | Fujita | 16/330 |
| 6,457,207 | B1 * | 10/2002 | Horberg | 16/50 |
| 6,532,627 | B1 * | 3/2003 | Audisio | 16/334 |
| 6,983,514 | B1 * | 1/2006 | Lu et al. | 16/342 |

FOREIGN PATENT DOCUMENTS

| | | | |
|---|---|---|---|
| CH | 561521 A | * | 5/1975 |
| FR | 2212851 A | * | 8/1974 |
| GB | 1437454 A | * | 5/1976 |

* cited by examiner

*Primary Examiner*—Brian E. Glessner
*Assistant Examiner*—Mark Williams
(74) *Attorney, Agent, or Firm*—Mark W. Croll; Paul F. Donovan

(57) ABSTRACT

A hinge apparatus includes first and second hinge parts and a hinge pin assembly interconnecting the hinge parts. Cams on the hinge pin assembly are operatively associated for rotation with the hinge parts. Engaging surfaces of the cams provide dwell points during movement of the hinge parts relative to each other.

13 Claims, 3 Drawing Sheets

HINGE APPARATUS WITH CHECK MECHANISM

CROSS-REFERENCE TO RELATED APPLICATION

The present application claims benefit to U.S. Provisional Application Ser. No. 60/386,827 filed on Jun. 7, 2002.

FIELD OF THE INVENTION

The present invention relates generally to hinge assemblies, and, more particularly, the invention relates to automobile hinge assemblies with check mechanisms providing intermediate dwell points between the open and closed positions.

BACKGROUND OF THE INVENTION

For opening and closing automobile passenger doors, it is desirable to provide hinge assemblies that create intermediate dwell points between the fully open and fully closed positions of the door. The dwell points prevent the door from swinging uncontrollably between the extreme positions. The dwell positions for the door enable ingress and egress of passengers in confined spaces, without requiring the door to be held. The dwell positions prevent the door from swinging fully open unintentionally, possibly striking another vehicle or a structure closely spaced from the door. The dwell positions hold the door from swinging closed, potentially striking an individual entering or leaving the automobile. The dwell positions also hold the door open at various angles for loading and unloading articles and things, by one person alone.

Known vehicle hinge systems with intermediate dwell points have been provided in a variety of assemblies. It is known to couple a more or less conventional hinge with a control arm having detents cooperating with a roller to provide the dwell points. It is also known to provide an integrated hinge with a check mechanism. An integrated hinge with a check mechanism providing intermediate dwell points is described in U.S. Pat. No. 6,012,201. In this patent, spaced camming surfaces are resiliently tracked by rollers connected to a compression spring.

Known vehicle door hinge systems have a variety of disadvantages. Hinge assemblies having separate hinges and control arms can increase cost and prolong and complicate assembly procedures. Known integrated assemblies having a check mechanism integrated with the hinge apparatus have been complex, thereby complicating installation and service and increasing expense both for providing the integrated assembly and for installing the assembly during manufacture of a vehicle.

What is needed is a vehicle door hinge apparatus that controls door opening and door closing, providing intermediate dwell positions, and that is simple, reliable, inexpensive and easy to install.

SUMMARY OF THE INVENTION

The present invention provides a vehicle hinge apparatus in which cooperating cam plates on the hinge pin providing intermediate dwell points for relative movement of the hinge parts about the hinge pin assembly.

In one aspect thereof, the present invention provides a hinge apparatus providing at least one intermediate dwell position. The hinge apparatus has a first hinge part and a second hinge part having interrelating structures. A hinge pin assembly interconnects the interrelating structures, permitting relative pivotal movement of the first and second hinge parts about an axis of rotation defined by the hinge pin assembly. The hinge pin assembly is provided with a pin. A first cam plate on the pin is associated with one of the first hinge part and the second hinge part for rotation therewith. The first cam plate has a first contoured surface. A second cam plate on the pin is associated with the other of the first hinge part and the second hinge part for rotation therewith. The second cam plate has a second contoured surface disposed against the first contoured surface. Biasing means urges the first and second contoured surfaces into cooperative engagement.

In another form thereof, the present invention provides a vehicle hinge apparatus for controlling swinging movement of a vehicle door, while providing intermediate dwell points in the movement. The hinge apparatus has a body hinge part including a first mounting plate and first and second side plates in spaced relation, and a door hinge part including a second mounting plate and third and fourth side plates in spaced relation. A hinge pin assembly interconnects the first, second, third and fourth side plates, and includes a hinge pin. A first cam plate is disposed on the pin, the first cam plate having a first contoured surface and being connected to one of the body hinge part and the door hinge part for rotation therewith. A second cam plate is disposed on the pin, the second cam plate having a second contoured surface and being connected to the other of the body hinge part and the door hinge part for rotation therewith. A spring means urges the first and second contoured surfaces into cooperative engagement.

In still another form thereof, the present invention provides a vehicle hinge apparatus with a first hinge part, a second hinge part and a hinge pin interconnecting the first and second hinge parts for relative rotational movement about an axis defined by the pin. First and second cams disposed on the hinge pin and operatively associated with the first and second hinge parts, respectively, have operatively engaging surfaces configured for providing alternating rotational zones of increased and decreased resistance to relative rotation.

An advantage of the present invention is providing a vehicle hinge with an integral check mechanism that is simple and inexpensive.

Another advantage of the present invention is providing an automobile hinge apparatus that is easy to install and effective in operation.

Still another advantage of the present invention is providing an automobile hinge apparatus with check mechanism that is reliable and easy to service.

Other features and advantages of the invention will become apparent to those skilled in the art upon review of the following detailed description, claims and drawings in which like numerals are used to designate like features.

Figure 1:
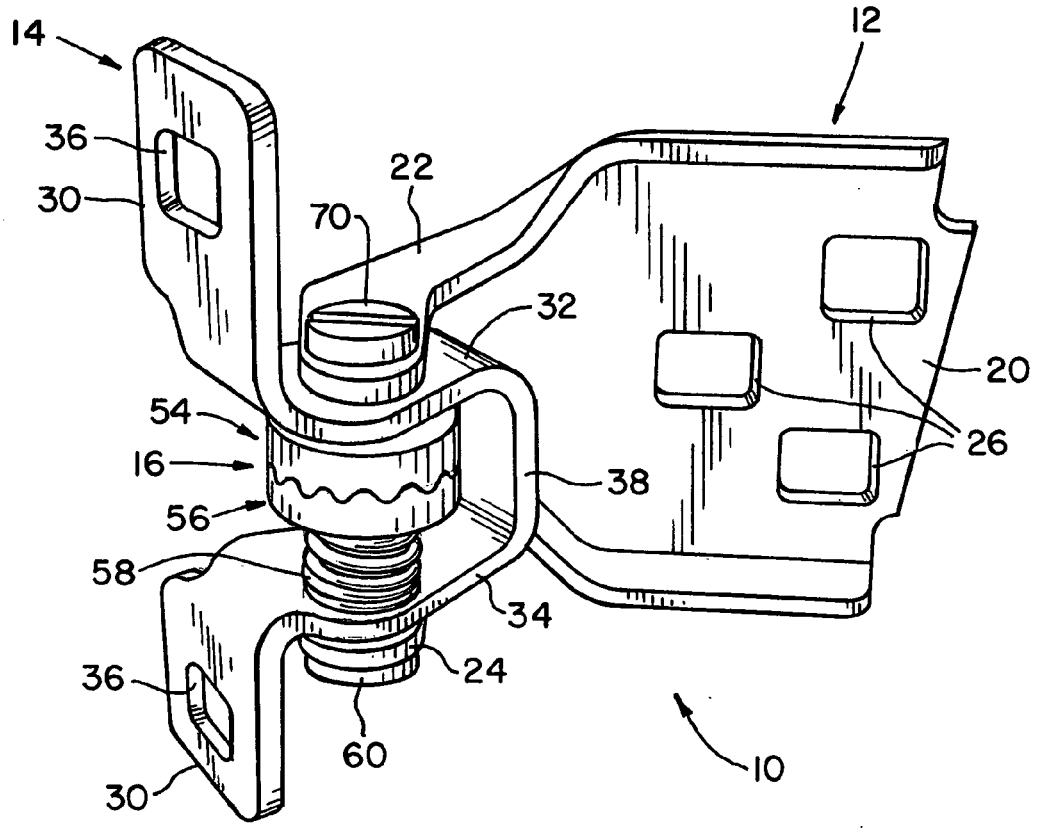
FIG. 1 is a perspective view of a hinge apparatus with check mechanism in accordance with the present invention.
Figure 2:
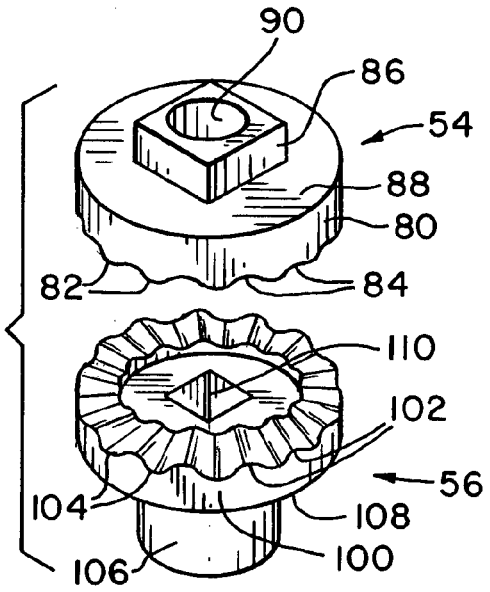
FIG. 2 is an exploded view of cams in the hinge apparatus shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use herein of "including" and "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a hinge apparatus 10 according to the present invention is shown. Hinge apparatus 10 can be used advantageously in a variety of applications and devices, and is particularly suitable and advantageous for use as a hinge for passenger doors in automobiles (not shown).

Hinge apparatus 10 includes a first hinge part 12 and a second hinge part 14, which in automobile applications of hinge apparatus 10 may be connected to the vehicle body (not shown) and the vehicle door (not shown), respectively. First and second hinge parts 12 and 14 have inter-relating structures, to be described more fully hereinafter, that are interconnected by a hinge pin assembly 16 about which relative pivotal movement of first and second hinge parts 12 and 14 occurs.

First hinge part 12 includes a first mounting plate 20 and first and second side plates 22 and 24, respectively. First and second side plates 22 and 24 are spaced from each other and connected to first mounting plate 20 on opposite sides thereof. In a preferred structure, first hinge part 12, including first mounting plate 20 and first and second side plates 22 and 24, is a single, monolithic body of shaped metal formed by stamping or the like. First mounting plate 20 defines one or more openings 26 for receiving bolts, screw, rivets or the like by which first hinge part 12 can be mounted to a vehicle body, frame or other structure on which hinge apparatus 10 is used. In the exemplary embodiment shown, first mounting plate 20 defines three openings 26, but it should be understood that more or fewer openings 26 can be used.

Second hinge part 14 includes at least one second mounting plate 30, and in the exemplary embodiment shown includes two second mounting plates 30. Third and fourth side plates 32 and 34 are spaced from each other and connected to the at least one second mounting plate 30. In the exemplary embodiment shown, third and fourth side plates 32 and 34 are each connected to a different second mounting plate 30. Second mounting plate or plates 30 define one or more openings 36 for receiving bolts, screw, rivets or the like (not shown) by which second hinge part 14 can be mounted to a vehicle door, frame or other structure on which hinge apparatus 10 is used. In the exemplary embodiment shown, each second mounting plate 30 defines one such opening 36, but it should be understood that more or fewer openings 26 can be used. In a preferred structure for second hinge part 14, a bridge 38 extends between distal ends of third and fourth side plates 32 and 34, opposite second mounting plates 30. Third and fourth side plates 32 and 34 and bridge 38 form a generally u-shaped structure, and second mounting plates 30 are formed as tabs extending laterally from third and fourth side plates 32 and 34. Second hinge part 14, including second mounting plates 30, third and fourth side plates 32 and 34, and bridge 38, is preferably a monolithic body of shaped metal formed by stamping or the like.

First, second, third and fourth side plates 22, 24, 32 and 34 define interrelating structure by which first and second hinge parts 12 and 14 are operatively joined to each other by hinge pin assembly 16. In the exemplary embodiment shown, third and fourth side plates 32 and 34 are spaced from each other a distance slightly less than a distance by which first and second side plates 22 and 24 are spaced from each other. In the assembled structure, third and fourth side plates 32 and 34 fit between and adjacent first and second side plates 22 and 24, respectively. First, second, third and fourth side plates 22, 24, 32 and 34 define apertures 42, 44, 46 and 48, respectively, which in assembled position are aligned with each other for receiving hinge pin assembly 16 extending therethrough. Apertures 42, 44, 46 and 48 are variously shaped for associating with components of hinge pin assembly, to be described subsequently, such that the components of hinge pin assembly are rotationally associated with one or the other of first and second hinge parts 12 and 14, to rotate therewith. In this regard, first and fourth apertures 42 and 48 are round, and second and third apertures 44 and 46 are square, although those skilled in the art will understand that other shapes also can be used.

Figure 4:
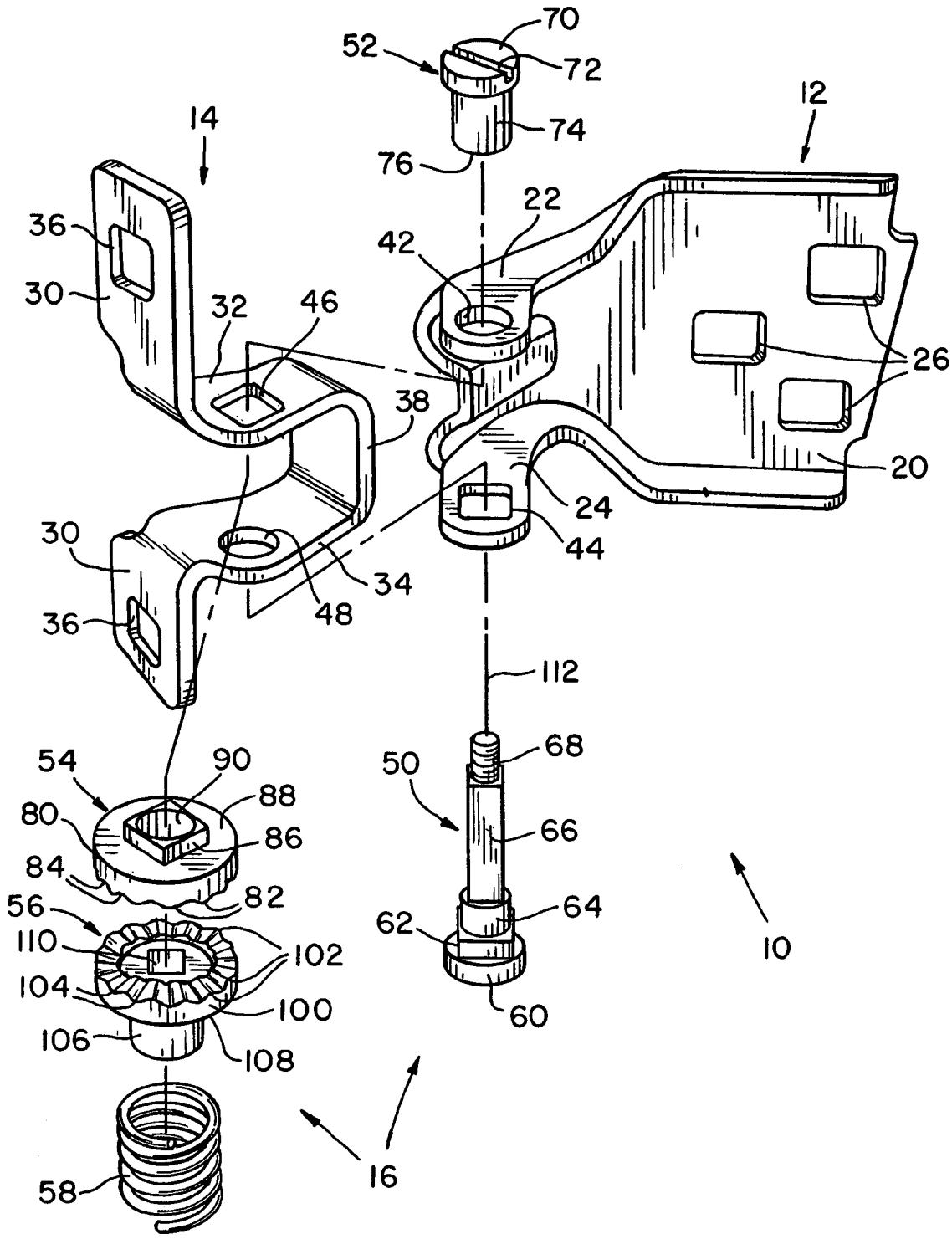
FIG. 4 is an exploded view of the hinge apparatus shown in FIG. 1.

Hinge pin assembly 16, the details of which can be seen most clearly in the exploded view of FIG. 4, includes a pin 50, a cap 52 engaging pin 50, first and second cams 54 and 56 on pin 50, and a coil spring 58 also on pin 50.

Pin 50 includes a head 60 that may be shaped for engagement by a hand or power tool such as a wrench, screwdriver or other implement. A square body portion 62 is provided adjacent head 60, and is sized and shaped to be received securely in square second aperture 44. A round body portion 64 is provided adjacent square body portion 62, and round body portion 64 is sized and shaped to be received rotatably in round fourth aperture 48. Pin 50 further includes an elongated shank portion 66 having flat sides and advantageously square in cross section. Opposite head 60, pin 50 defines a threaded end 68.

Cap 52 includes a head 70 that may be shaped for engagement by a hand or power tool such as a wrench, screwdriver or other implement. As illustrated, head 70 includes a slot 72 for receiving the blade of a screwdriver, although other configurations can be used as well. A elongated body portion 74 that is round in cross-section is provided adjacent head 70, sized and shaped to be received rotatably in round first aperture 42. Cap 52 defines an internally threaded cavity (not shown) inwardly from end 76, for engaging threaded end 68 of pin 50.

First cam 54 includes a first cam plate 80 having a first contoured inner surface defining a plurality of alternating peaks 82 and valleys 84, only some of which are designated with numbers 82 and 84, respectively, in the drawings. A square body 86 projects outwardly from an outer surface 88 of first cam 54. Square body 88 is sized and shaped to be received securely in square third aperture 46. First cam 54 defines a round axial opening 90 therethrough, for receiving round body portion 74 of cap 52, while allowing axial rotation of first cam 54 relative to cap 52.

Second cam 56 includes a second cam plate 100 having a second contoured inner surface defining a plurality of alternating peaks 102 and valleys 104, only some of which are designated with numbers 102 and 104, respectively, in the drawings. An elongated cylinder 106 projects outwardly from an outer surface 108 of second cam 56. Second cam 56 defines a square axial opening 110 therethrough, for receiving flat sided shank portion 66 of pin 50, limiting axial rotation of second cam 56 on and relative to pin 50.

Coil spring 58 is disposed around cylinder 106, extending between outer surface 108 of second cam 56 and fourth side plate 34. Spring 58 exerts biasing force against second cam plate 100, toward first cam plate 80, during operation and use of hinge apparatus 10.

Rotation of various parts of hinge apparatus 10 relative to other parts of hinge apparatus 10, to be described subsequently herein, occurs about an axis of rotation shown by dashed line 112 in the exploded view of FIG. 4.

In the assembled configuration of hinge apparatus 10, first cam 54 is operatively associated for rotation with second hinge part 14, as a result of square body 86 being closely received in square third aperture 46 of second hinge part 14. Second cam 56 is operatively associated for rotation with first hinge part 12, as a result of square shank portion 66 of pin 50 being closely received in square axial opening 110 in second cam 26, and square body portion 62 of pin 50 being closely received in square second aperture 44 of first hinge part 12.

Thus, as first hinge part 12 and second hinge part 14 rotate about axis 112 relative to each other, relative rotation occurs between first cam 54 and second cam 56. Although first cam 54 and second cam 56 fit relatively closely between third and fourth side plates 32 and 34, some limited relative axial movement can occur between cams 54 and 56. However, at the same time, coil spring 58 urges second cam 56 toward first cam 54, and both cams 54 and 56 toward third side plate 32.

Figure 3:
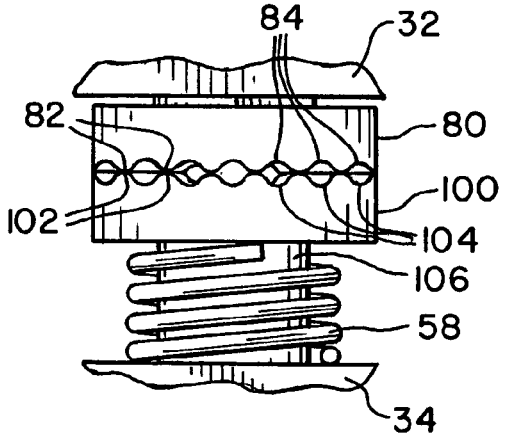
FIG. 3 is an elevational view of the hinge pin assembly, illustrating the cams in an intermediate stage of operation.

The shapes of peaks 82 relative to valleys 104, and peaks 102 relative to valleys 84, together with the strength of force applied by coil spring 58, are selected to provide the desired "feel" during operation of hinge apparatus 10. The peaks 82, 102 and valleys 84, 104 are arranged as alternating, generally radially oriented features, defining an essentially corrugated surface on each of cams 54, 56. By providing limited surfaces of contact between peaks 82 and 102, as illustrated in FIG. 3, cams 54 and 56, under the urging of spring 58, tend to rotate to positions wherein peaks 82 are nested in valleys 104 and peaks 102 are nested in valleys 84, as shown in FIG. 1. The nested positions create dwell points tending to hold the positions of first and second hinge parts 12 and 14 relative to each other.

To move peaks 82 and 102 out of valleys 104 and 84 respectively, force sufficient to overcome spring 58 is required, so that limited relative axial movement occurs between cams 54 and 56. The limited axial movement of cams 54 and 56 relative to each other allows the peaks of each cam to climb out of the valleys in the other cam, passing through the tip-to-tip position shown in FIG. 3, before quickly and easily settling into the next adjacent valley 84 or 104. In operating the hinge, resistance is felt as peaks 82, 102 climb out of valleys 104, 84, until the tip-to-tip orientation is achieved. Thereafter, less resistance is felt as the cams move into the nested position shown in FIG. 1, under the urging of spring 58.

Figure 5:
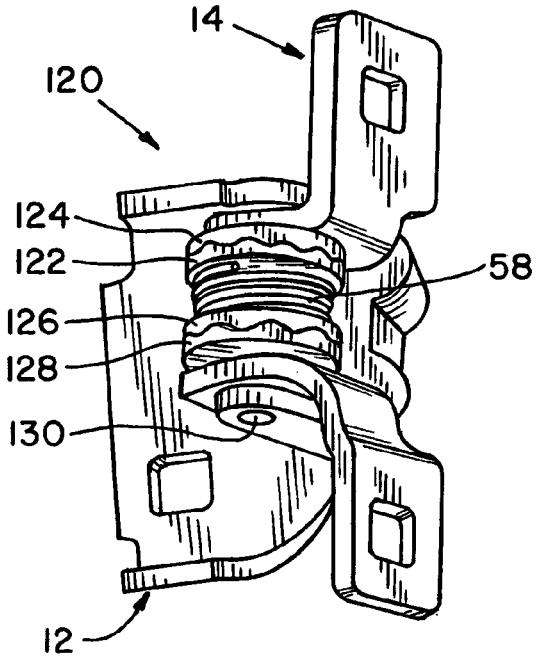
FIG. 5 is a perspective view of a modified form of the hinge pin assembly in accordance with the present invention.

The present hinge apparatus is capable of further modifications and variations to achieve operational advantages, as well as advantages during assembly. FIG. 5 illustrates a modified form of the present invention in which a hinge apparatus 120 has first and second cams 122 and 124 in inner and outer positions, respectively, adjacent third side plate 32. Apparatus 120 further includes third and fourth cam plates 126 and 128 in inner and outer positions, respectively, adjacent fourth side plate 34. Coil spring 58 is operative positioned between first and third cam plates 122 and 126 that are keyed on a hinge pin 130 operatively associated with first hinge part 12, such as described for associating pin 50 with first hinge part 12 of hinge apparatus 10. Second and fourth cams 124 and 128, disposed in the outer positions, are keyed to third and fourth side plates 32 and 34, for rotational association with second hinge part 14. Knobs 132 (FIG. 6) or other structures can be used for securing cams 124 and 128 to third and fourth side plates 32 and 34, respectively.

Figure 6:
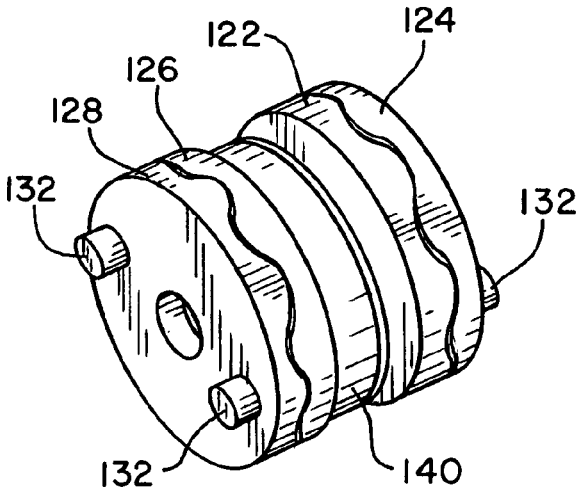
FIG. 6 is a perspective view of a further modified form of the hinge pin assembly in accordance with the present invention.

Biasing means other than a coil spring 58 can be used. FIG. 6 illustrates a modified form of the present invention in which a set of belleville washers 140 is used between inner cams 122 and 126. Belleville washers are a suitable alternative since the required distance for axial movement of the cams is small.

Figure 7:
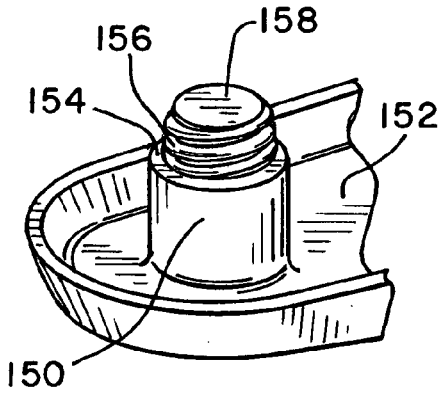
FIG. 7 is a perspective view of a still further modification of the hinge apparatus of the present invention.

FIG. 7 illustrates a modified form of the invention that provides advantages during assembly. An enlargement 150 is provided on an outermost side plate 152, and defines a threaded opening 154 for receiving a threaded end 156 of a pin 158 in hinge pin assembly 16. Cap 52 is not required. Assembly is simplified in that fewer independent, discrete parts are required.

The hinge apparatus of the present invention is simple and inexpensive compared to previous integrated hinges with check mechanisms. An effective check mechanism is provided, arresting uncontrolled movement of an automobile door, for example, for which the present hinge apparatus 10 is used particularly advantageously. Further, the automobile door, for example, tends to stay where positioned, with peaks 82 and 102 nested in valleys 104 and 84, respectively, and the door will not move undesirably or unintentionally, without the application of additional force to move it.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set fourth in the following claims.

What is claimed is:

1. A hinge apparatus comprising:

a first hinge part having a first mounting plate and first and second side plates;

a second hinge part having a second mounting plate and third and fourth side plates, said third and fourth side plate being disposed between said first and second side plates; and a hinge pin assembly extending between said first, second, third and fourth side plates and permitting relative pivotal movement of said first and second hinge parts about an axis of rotation defined by said hinge pin assembly; said hinge pin assembly comprising:

a pin having a flat sided shank portion, a head and a threaded end, said head disposed adjacent one of said first and second side plates and said threaded end received in the other of said first and second side plates, said pin being fixed with respect to a longitudinal direction of the axis of rotation extending between the first and second side plates;

a first cam plate on said pin and associated with one of said first hinge part and said second hinge part for rotation therewith, said first cam plate having a first contoured surface;

a second cam plate having a flat sided axial opening disposed on said flat sided shank portion on said pin and associated with the other of said first hinge part and said second hinge part for rotation therewith, said second cam plate having a second contoured surface disposal against said first contoured surface;

said first and second cam plates being disposed between said third and fourth side plates; and biasing means urging said first and second contoured surfaces into cooperative engagement;

wherein said first and second contoured surfaces are configured and arranged to create a plurality of dwell points such that said first and second hinge parts can be held in a plurality of positions between open and closed positions.

2. The hinge apparatus of claim 1, said first and second cam plates disposed adjacent one of said third and fourth side plates, and said biasing means comprising a spring disposed between the other one of said third and fourth side plates and said cam plates.

3. A hinge apparatus providing at least one intermediate dwell position, said hinge apparatus comprising:

a first hinge part and a second hinge part having interrelating structures; and a hinge pin assembly interconnecting said interrelating structures permitting relative pivotal movement of said first and second hinge parts about an axis of rotation defined by said hinge pin assembly; said hinge pin assembly comprising:

a pin;

a first cam plate on said pin and associated with one of said first hinge part and said second hinge part for rotation therewith, said first cam plate having a first contoured surface;

a second cam plate on said pin and associated with the other of said first hinge part and said second hinge part for rotation therewith, said second cam plate having a second contoured surface disposed against said first contoured surface;

biasing means urging said first and second contoured surfaces into cooperative engagement;

a third cam plate on said pin and associated with one of said first and second hinge parts for rotation therewith, said third cam plate having a third contoured surface;

a fourth cam plate on said pin and associated for rotation with the one of said first and second hinge parts not associated with said third cam plate, said fourth cam plate having a fourth contoured surface disposed against said third contoured surface; and said biasing means urging said third and fourth contoured surfaces into cooperative engagement.

4. The hinge apparatus of claim 3, said pin having a threaded end, and one of said interrelating structure defining a threaded enlargement for engaging said threaded end.

5. The hinge apparatus of claim 3, said first and second cam plates spaced from said third and fourth cam plates, and said biasing means disposed therebetween.

6. The hinge apparatus of claim 5, said biasing means comprising a spring.

7. The hinge apparatus of claim 5, said biasing means comprising belleville washers.

8. A vehicle hinge apparatus for controlling swinging movement of a vehicle door, while providing intermediate dwell points in said movement, said hinge apparatus comprising:

a body hinge part including a first mounting plate and first and second side plates in spaced relation;

a door hinge part including a second mounting plate and third and fourth side plates in spaced relation, said third and fourth side plates disposed between said first and second side plates; and a hinge pin assembly interconnecting said first, second, third and fourth side plates, said hinge pin assembly including:

a hinge pin having a flat sided shank portion and a non-circular body portion located on one end thereof, said non-circular body portion being sized and shaped to be received by a mating portion in one of said body hinge part and said door hinge part;

a first cam plate disposed on said pin, said first cam plate having a first contoured surface and being connected to one of said body hinge part and said door hinge part for rotation therewith;

a second cam plate having a flat sided axial opening disposed on said flat sided shank portion of said pin, said second cam plate having a second contoured surface and being connected to the other of said body hinge part and said door hinge part for rotation therewith;

said first and second cam plates disposed between said third and fourth side plates;

a spring disposed on said pin between said third and fourth side plates urging said first and second contoured surfaces into operative engagement; and a cap secured to a end of said hinge pin that is opposite to said end of said pin having said non-circular body portion, said cap including a cylindrical body portion that is sized and shaped to be received rotatably by a mating portion in the other of said body hinge part and said door hinge part.

9. The vehicle hinge apparatus of claim 8, said pin having a threaded end, and one of said first and second side plate defining a threaded enlargement for engaging said threaded end.

10. A vehicle hinge apparatus for controlling swinging movement of a vehicle door, while providing intermediate dwell points in said movement, said hinge apparatus comprising:

a body hinge part including a first mounting plate and first and second side plates in spaced relation;

a door hinge part including a second mounting plate and third and fourth side plates in spaced relation; and a hinge pin assembly interconnecting said first, second, third and fourth side plates, said hinge pin assembly including:

a hinge pin;

a first cam plate disposed on said pin, said first cam plate having a first contoured surface and being connected to one of said body hinge part and said door hinge part for rotation therewith;

a second cam plate disposed on said pin, said second cam plate having a second contoured surface and being connected to due other of said body hinge part and said door hinge part for rotation therewith;

spring using said first and second contoured surfaces into operative engagement;

third and fourth cam plate disposed on said pin, said third and fourth cam plates having third and fourth contoured surfaces, respectively, and said spring means urging said third and fourth contoured surfaces into cooperative engagement.

11. The vehicle hinge apparatus of claim 10;

said third cam plate associated with one of said first and second cam plates for relative rotation therewith, and said fourth cam plate associated with the other of said first and second cam plates for relative rotation therewith; and said first and second cam plates being disposed on said pin spaced from said third and fourth cam plates disposed on said pin, and said spring means disposed therebetween.

12. The vehicle hinge apparatus of claim 11, said spring means comprising a coil spring.

13. The vehicle hinge apparatus of claim 11, said spring means comprising belleville washers.

* * * * *